US010711636B2

(12) United States Patent
Calla et al.

(10) Patent No.: US 10,711,636 B2
(45) Date of Patent: Jul. 14, 2020

(54) FEEDSTOCKS FOR USE IN COATING COMPONENTS

(71) Applicant: General Electric Company, Schenectady, NY (US)

(72) Inventors: Eklavya Calla, Karnataka (IN); Joydeep Pal, Karnataka (IN); Krishnamurthy Anand, Karnataka (IN)

(73) Assignee: General Electric Company, Schenectady, NY (US)

( * ) Notice: Subject to any disclaimer, the term of this patent is extended or adjusted under 35 U.S.C. 154(b) by 463 days.

(21) Appl. No.: 14/977,833

(22) Filed: Dec. 22, 2015

(65) Prior Publication Data

US 2017/0175570 A1 Jun. 22, 2017

(51) Int. Cl.

| | |
|---|---|
| ***F01D 25/00*** | (2006.01) |
| ***C23C 4/06*** | (2016.01) |
| ***F01D 5/28*** | (2006.01) |

(52) U.S. Cl.

CPC ..... *F01D 25/005* (2013.01); *C23C 4/06* (2013.01); *F01D 5/288* (2013.01); *F05D 2220/32* (2013.01); *F05D 2230/311* (2013.01); *F05D 2230/90* (2013.01); *F05D 2300/5023* (2013.01); *F05D 2300/611* (2013.01)

(58) Field of Classification Search

None

See application file for complete search history.

(56) References Cited

U.S. PATENT DOCUMENTS

| | | | | |
|---|---|---|---|---|
| 5,059,095 | A * | 10/1991 | Kushner | C23C 4/02 29/889.21 |
| 6,793,706 | B1 | 9/2004 | Hebsur | |
| 6,921,586 | B2 | 7/2005 | Zhao et al. | |
| 7,135,238 | B2 | 11/2006 | Raybould et al. | |
| 7,858,205 | B2 | 12/2010 | Allen et al. | |
| 8,197,895 | B2 | 6/2012 | Arndt et al. | |
| 8,544,769 | B2 | 10/2013 | Calla et al. | |
| 2006/0090593 | A1 | 5/2006 | Liu | |
| 2010/0143700 | A1 | 6/2010 | Champagne et al. | |
| 2012/0009432 | A1* | 1/2012 | Cox | C23C 4/08 428/552 |
| 2014/0283995 | A1* | 9/2014 | Tanaka | C04B 35/443 156/345.33 |

FOREIGN PATENT DOCUMENTS

WO 2008084025 A3 7/2008

OTHER PUBLICATIONS

US Research Nanomaterials, Inc.; http://www.us-nano.com/inc/sdetail/3821; accessed Dec. 14, 2017.*

(Continued)

*Primary Examiner* — Jethro M. Pence

(74) *Attorney, Agent, or Firm* — Armstrong Teasdale LLP

(57) ABSTRACT

A system for coating a component is provided. The system includes a feedstock supply, a carrier fluid supply, and a thermal spray gun coupled in flow communication with the feedstock supply and the carrier fluid supply. The feedstock supply contains a substantially homogeneous powder mixture of a first powder and a second powder. The second powder is softer than the first powder and has a percentage by mass of the powder mixture of between about 0.1% and about 3.0%.

15 Claims, 4 Drawing Sheets

(56) References Cited

OTHER PUBLICATIONS periodictable.com; http://periodictable.com/Properties/A/MohsHardness.v.html; accessed Dec. 14, 2017.*

Giummarra et al., "Improving the Fatigue Response of Aerospace Structural Joints", ICAF 2005 Proceedings, Hamburg, Germany, 12 pages, available at http://www.lambdatechs.com/documents/258.pdf.

Butz et al., "Improvement in Fatigue Resistance of Aluminum Alloys by Surface Cold-Working", Materials Research & Standards, Dec. 1961, pp. 951-956, available at http://www.shotpeener.com/library/pdf/1961002.pdf.

* cited by examiner

FEEDSTOCKS FOR USE IN COATING COMPONENTS

BACKGROUND

The field of this disclosure relates generally to coatings and, more particularly, to thermal barrier coatings for use on components of gas turbine assemblies.

Many known gas turbine assemblies include a compressor, a combustor, and a turbine. Gases flow into the compressor and are compressed. The compressed gases are then discharged into the combustor, mixed with fuel, and ignited to generate combustion gases. The combustion gases are channeled from the combustor through the turbine, thereby driving the turbine which, in turn, may power an electrical generator coupled to the turbine.

At least some components of gas turbine assemblies are known to operate in higher-temperature environments, such that the components are more susceptible to damage. In that regard, it is common to apply a thermal barrier coating to these components in an effort to lessen their exposure to higher temperatures. However, during at least some operating conditions of the gas turbine assemblies, these components may undergo thermal and/or mechanical stress that causes the components to change shape, and many known thermal barrier coatings have a tendency to fracture as a result of being overly rigid in response to such a shape change.

BRIEF DESCRIPTION

In one aspect, a system for coating a component is provided. The system includes a feedstock supply, a carrier fluid supply, and a thermal spray gun coupled in flow communication with the feedstock supply and the carrier fluid supply. The feedstock supply contains a substantially homogeneous powder mixture of a first powder and a second powder. The second powder is softer than the first powder and has a percentage by mass of the powder mixture of between about 0.1% and about 3.0%.

In another aspect, a method for coating a component is provided. The method includes supplying a carrier fluid to a thermal spray gun and supplying a substantially homogeneous powder mixture to the thermal spray gun. The method also includes discharging the powder mixture from the thermal spray gun via the carrier fluid to deposit a coating on the component. The powder mixture includes a first powder and a second powder that is softer than the first powder and has a percentage by mass of the powder mixture of between about 0.1% and about 3.0%.

In another aspect, a component of a gas turbine assembly is provided. The component includes a substrate and a coating deposited on the substrate. The coating has a microstructure that includes a plurality of first lamellae and a plurality of second lamellae. The second lamellae are softer than the first lamellae and have a percentage by mass of the coating of between about 0.1% and about 3.0%.

DETAILED DESCRIPTION

The following detailed description illustrates coating systems and methods by way of example and not by way of limitation. The description should enable one of ordinary skill in the art to make the systems, and use the systems and methods, and the description describes several embodiments of the systems and methods, including what are presently believed to be the best modes of making the systems, and using the systems and methods. Exemplary systems and methods are described herein as being used in relation to components of a gas turbine assembly. However, it is contemplated that the systems and methods have general application to a broad range of systems in a variety of fields other than gas turbine assemblies.

Figure 1:
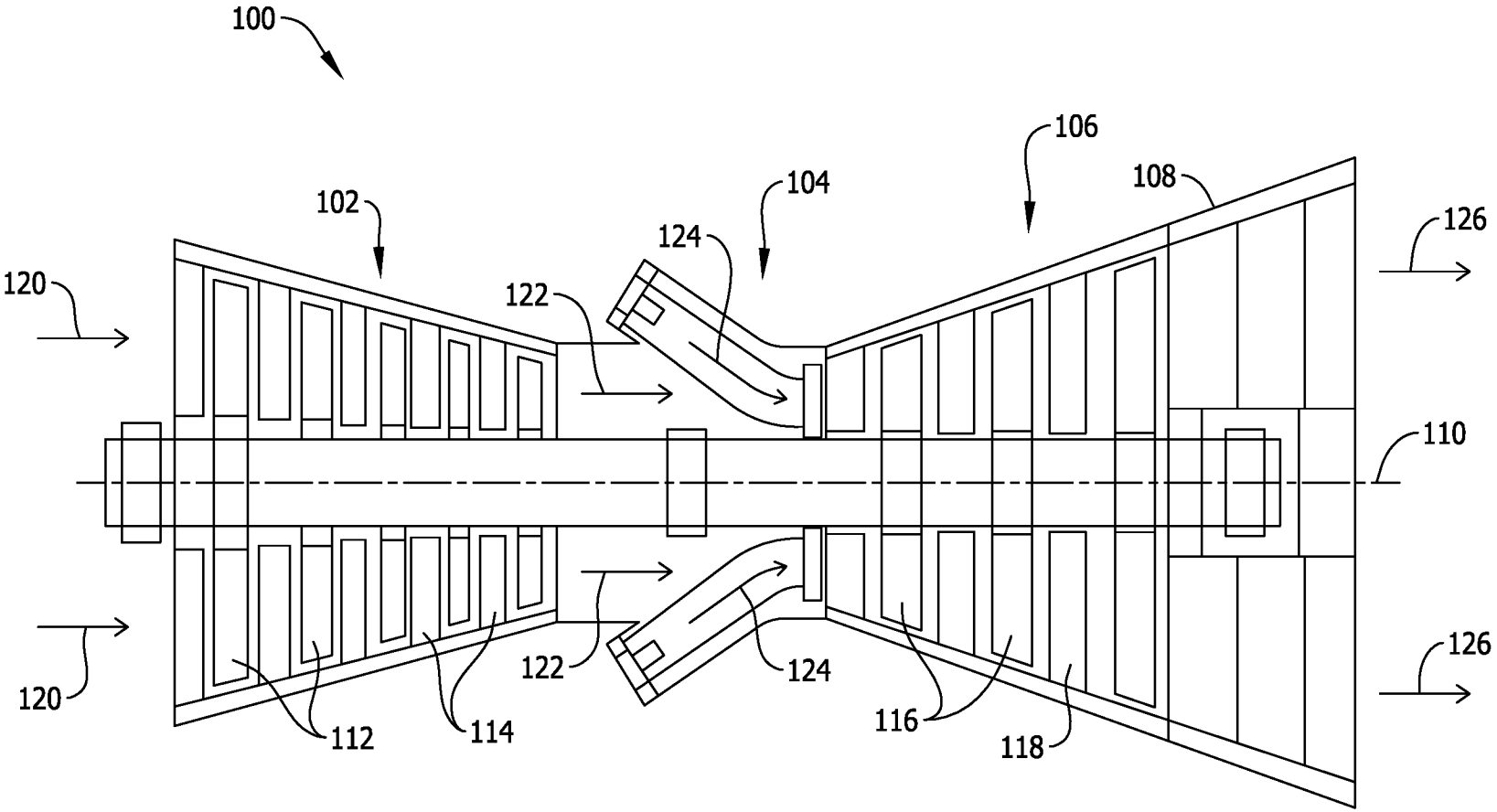
FIG. 1 is a schematic illustration of a gas turbine assembly.

FIG. 1 illustrates an exemplary gas turbine assembly 100. In the exemplary embodiment, gas turbine assembly 100 has a compressor 102, a combustor 104, and a turbine 106 coupled in flow communication with one another within a casing 108 and spaced along a centerline axis 110. Compressor 102 includes a plurality of rotor blades 112 and a plurality of stator vanes 114, and turbine 106 likewise includes a plurality of rotor blades 116 and a plurality of stator vanes 118. In other embodiments, gas turbine assembly 100 may have any suitable configuration that facilitates enabling gas turbine assembly 100 to function as described herein.

During operation of gas turbine assembly 100, working gases 120 (e.g., ambient air) flow into compressor 102 and are compressed and channeled into combustor 104. Compressed gases 122 are mixed with fuel and ignited in combustor 104 to generate combustion gases 124 that are channeled into turbine 106 and interact with rotor blades 116 to drive an electrical generator (not shown). Combustion gases 124 are then discharged from turbine 106 as exhaust gases 126.

In the exemplary embodiment, at least some components of gas turbine assembly 100 (e.g., component(s) of combustor 104 and/or turbine 106) may be subjected to environmental conditions that can limit the useful life of the components. For example, rotor blades 116 may experience higher temperatures during at least some operating cycles of gas turbine assembly 100, and the higher temperatures can increase the thermal stresses on rotor blades 116, such that rotor blades 116 are more susceptible to fracture and/or plastic deformation. Other environmental conditions that can increase the stresses on components of gas turbine assembly 100 may include environmental conditions that promote mechanical wear, corrosion, and/or exposure to electrical/magnetic fields. It is therefore desirable to facilitate protecting at least some components of gas turbine assembly 100 (e.g., rotor blades 116) from such environmental conditions.

Figure 2:
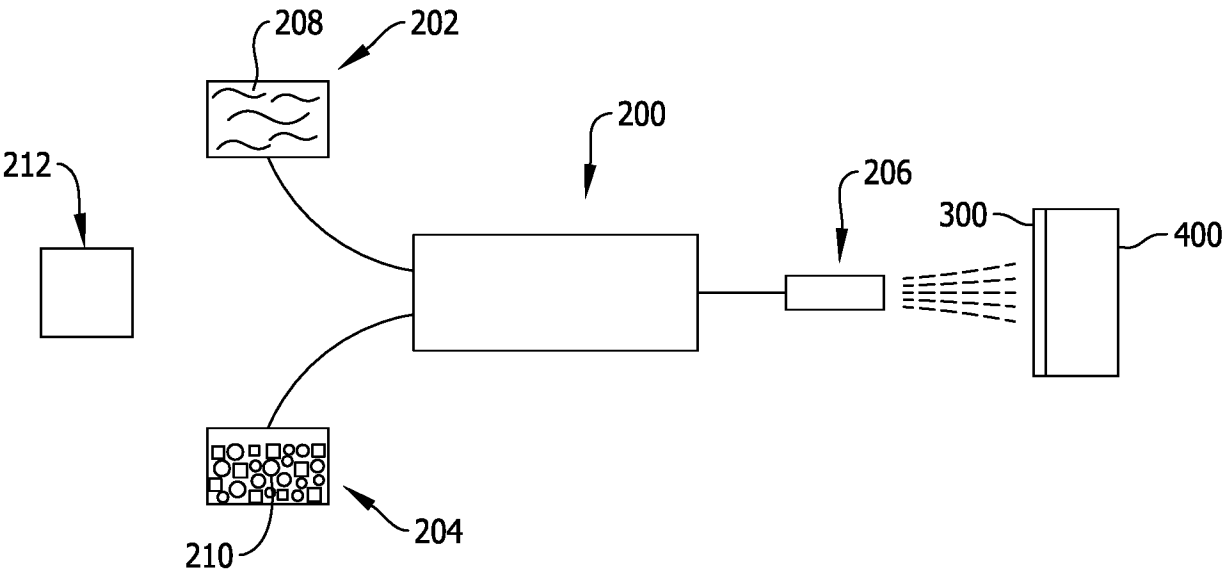
FIG. 2 is a schematic illustration of an exemplary system for depositing a coating on a component of the gas turbine assembly shown in FIG. 1.

FIG. 2 is a schematic illustration of an exemplary system 200 for depositing a coating 300 (e.g., a thermal barrier coating) on a substrate 400 (e.g., a substrate of a component of gas turbine assembly 100). In the exemplary embodiment, system 200 is a thermal spray system including a carrier fluid supply 202, a feedstock supply 204, and a spray gun 206 coupled in flow communication with carrier fluid supply 202 and feedstock supply 204. Carrier fluid supply 202 contains a carrier fluid 208 (e.g., helium gas, nitrogen gas, and/or oxygen gas), and feedstock supply 204 contains a feedstock material 210 in the form of a powder mixture (e.g., a substantially homogeneous powder mixture) that is pre-mixed using a mixer 212.

In the exemplary embodiment, spray gun 206 is constructed to utilize a thermal spray technique to deliver feedstock material 210 from feedstock supply 204 to substrate 400 via carrier fluid 208 for depositing coating 300 on substrate 400. In one embodiment, spray gun 206 may utilize a high velocity oxy-fuel (HVOF) spray technique. In another embodiment, spray gun 206 may utilize a plasma spray technique (e.g., an atmospheric plasma spray (APS) technique or a low pressure plasma spray (LPPS) technique). In some embodiments, spray gun 206 may utilize a cold spray technique. Alternatively, spray gun 206 may utilize any other suitable spray technique to deliver feedstock material 210 to substrate 400 and deposit coating 300 on substrate 400 in a manner that facilitates enabling coating 300 to function as described herein.

Figure 3:
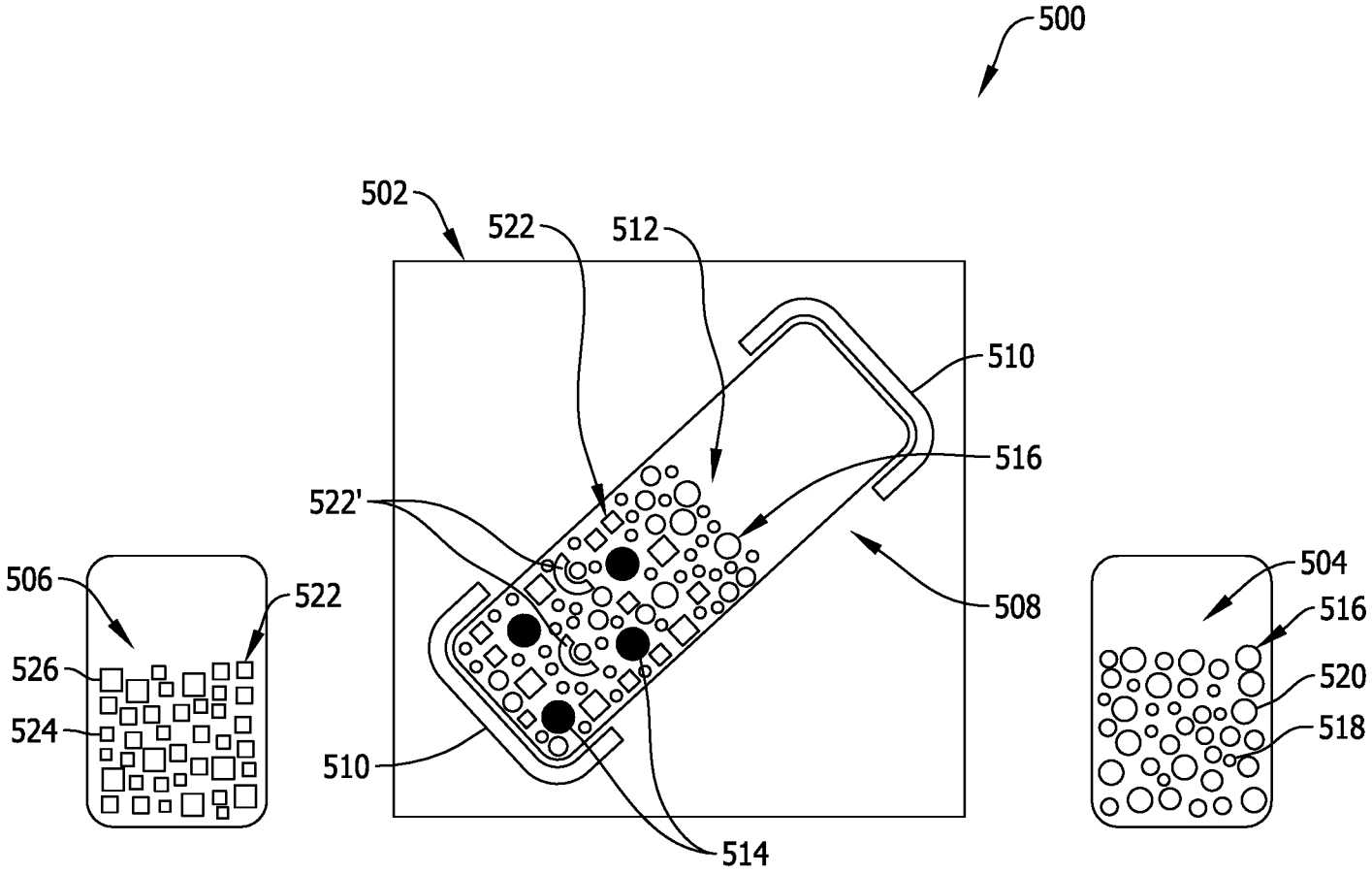
FIG. 3 is a schematic illustration of an exemplary mixer for use in the system shown in FIG. 2.

FIG. 3 is a schematic illustration of an exemplary mixer 500 for use in system 200 to prepare (e.g., pre-mix) feedstock material 210. In the exemplary embodiment, mixer 500 includes a shaker-type mixing device 502 (such as, for example, a Turbula® mixing device) that facilitates mixing a first powder 504 and a second powder 506 (each of which has a different specific weight and/or particle size as compared to the other) to form a substantially homogeneous powder mixture 512. Mixing device 502 includes a container 508 and an automated basket 510 for displacing container 508 in a dynamic, three-dimensional motion that includes rotation, translation, and inversion of container 508. In other embodiments, mixer 500 may include any suitable mixing device 502 that facilitates mixing first powder 504 and second powder 506 to form powder mixture 512, and facilitates depositing coating 300 on substrate 400 in a manner that enables coating 300 to function as described herein.

In the exemplary embodiment, mixer 500 also includes a plurality of mixing balls 514 displaceable within container 508 of mixing device 502. Mixing balls 514 are substantially spherical, are made of a hard material (e.g., a hard ceramic material or a hard metallic material such as steel), and each have a diameter of between about seven millimeters and about ten millimeters. In other embodiments, mixer 500 may have any suitable quantity of mixing balls 514 displaceable within container 508 of mixing device 502 (e.g., mixer 500 may have only one mixing ball 514), and mixing balls 514 may be made of any suitable material(s) and may have any suitable size(s) that facilitate enabling mixing balls 514 to function as described herein. Additionally, in some embodiments, mixing balls 514 may not be substantially spherical in shape (e.g., mixing balls 514 may be substantially polyhedronal in some embodiments).

In the exemplary embodiment, first powder 504 is a made of at least one hard metallic material (e.g., a hardfacing metallic material) having a Mohs hardness of greater than five (e.g., a Mohs hardness of greater than seven in some embodiments). For example, first powder 504 may be at least one of the following metallic materials in powdered form: a Stellite™ alloy (e.g., Stellite™ alloy 6); a Tribaloy™ alloy (e.g., Tribaloy™ T-400 or Tribaloy™ T-800); an INCONEL® alloy (e.g., INCONEL® alloy 718 or INCONEL® alloy 625); a tungsten carbide cobalt-chromium (WC—CoCr) alloy; a chromium carbide nickel-chromium (CrC—NiCr) alloy; an aluminum oxide (e.g., aluminum (III) oxide); a chromium oxide (e.g., chromium (III) oxide); a titanium oxide (e.g., titanium (IV) oxide); a zirconium oxide (e.g., zirconium (IV) oxide); a yttrium oxide (e.g., yttrium (III) oxide); and a ceramic material. In some embodiments, first powder 504 has particles 516 (which are shown as circles for illustrative purposes only) of varying sizes (e.g., smaller particles 518 and larger particles 520). For example, in one embodiment, first powder 504 may have particles 516 with diameters that range between about five micrometers and about sixteen micrometers. In other embodiments, first powder 504 may be made of any suitable metallic material having any suitable hardness and any suitable particle size(s) that facilitate enabling coating 300 to function as described herein.

In the exemplary embodiment, second powder 506 is made of at least one soft metallic material having a Mohs hardness of at most five (e.g., a Mohs hardness of at most three in some embodiments). For example, second powder 506 may be one of the following metallic materials in powdered form: substantially pure aluminum; substantially pure zinc; substantially pure copper; substantially pure bismuth; and substantially pure tin. In some embodiments, second powder 506 has particles 522 (which are shown as squares for illustrative purposes only) of varying sizes (e.g., smaller particles 524 and larger particles 526). For example, in one embodiment, second powder 506 may have particles 522 with diameters that range between about fifteen micrometers and about forty-five micrometers. In other embodiments, second powder 506 may be made of any suitable metallic material having any suitable hardness and any suitable particle size(s) that facilitate enabling coating 300 to function as described herein.

To prepare powder mixture 512 using mixer 500, first powder 504 and second powder 506 are added to container 508 such that the percentage by mass of second powder 506 to powder mixture 512 is high enough to substantially improve a compliant property of coating 300 (e.g., is high enough to substantially improve the strain tolerance of coating 300) and is low enough to substantially not detract from the ability of coating 300 to effectively perform its hardfacing function (e.g., is low enough to substantially not detract from the ability of coating 300 to perform its wear/corrosion resistance, thermal barrier, and/or magnetic/electrical shielding function). In one embodiment, the percentage by mass of second powder 506 is between about 0.1% and about 3.0%. In another embodiment, the percentage by mass of second powder 506 is between about 0.1% and about 2.0%. In another embodiment, the percentage by mass of second powder 506 is between about 0.3% and about 0.7%. In another embodiment, the percentage by mass of second powder 506 is about 0.5%. In other embodiments, second powder 506 may be any suitable percentage by mass of powder mixture 512 that facilitates enabling coating 300 to function as described herein.

After adding first powder 504 and second powder 506 to container 508, container 508 is shaken for an extended duration (e.g., a duration of between four hours and eight hours in some embodiments) using automated mixing basket 510 to effectively pre-mix first powder 504 and second powder 506 into substantially homogeneous powder mixture 512 for use in feedstock supply 204. Notably, during the pre-mixing operation, mixing balls 514 move around within powder mixture 512, thereby substantially deforming (e.g., substantially flattening and bending) at least some particles 522 of second powder 506 substantially without deforming particles 516 of first powder 504. As a result, at least some substantially deformed particles 522' of second powder 506 each mechanically couples to at least one particle 516 of first powder 504 (e.g., at least some substantially deformed particles 522' of second powder 506 each partially encapsulates at least one particle 516 of first powder 504).

Figure 4:
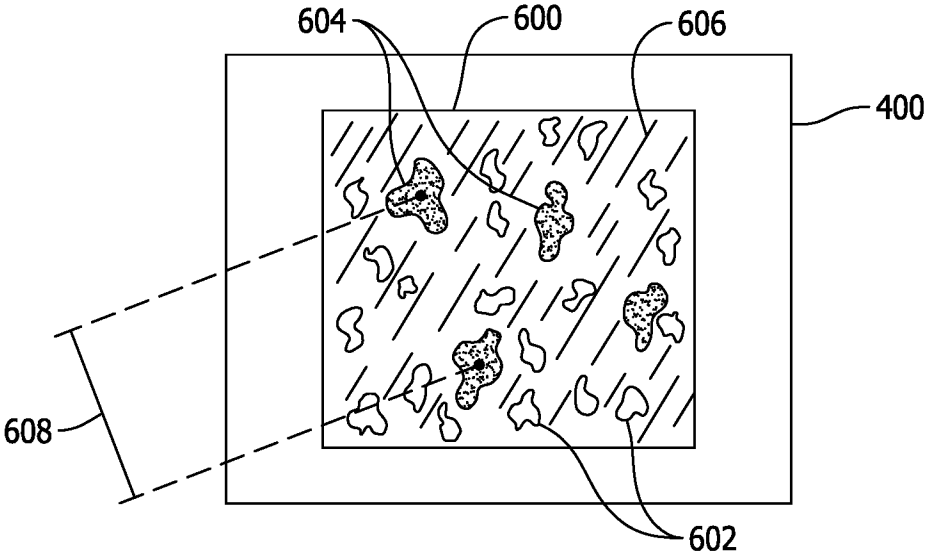
FIG. 4 is a schematic illustration of an exemplary substrate of a component of the gas turbine assembly shown in FIG. 1 having an exemplary coating deposited on the substrate using the system shown in FIG. 2.

FIG. 4 is a schematic illustration of substrate 400 having an exemplary coating 600 deposited thereon using system 200. In the exemplary embodiment, after first powder 504 and second powder 506 are pre-mixed as set forth above using mixer 500, powder mixture 512 is added to feedstock supply 204 and is thereby supplied to spray gun 206 for delivery to substrate 400 via carrier fluid 208 to deposit powder mixture 512 on substrate 400 as coating 600. More specifically, after being discharged from spray gun 206, powder mixture 512 impacts substrate 400 at a high velocity such that each particle 516 of powder mixture 512 forms a first lamella 602 and such that each particle 522 and 522' of powder mixture 512 forms a second lamella 604 after having plastically deformed (e.g., substantially flattened) on substrate 400 and mechanically coupled to substrate 400. Coating 600 is thereby deposited on substrate 400, with lamellae 602 and 604 embedded in a common microstructure 606 such that second lamellae 604 facilitate improving a fatigue property of coating 600 and/or substrate 400 as set forth in more detail below. In one embodiment, coating 600 may have a thickness of between about forty micrometers and about four centimeters, with lamellae 604 serving as localized areas of softer material that, when viewed from the top-down as shown in FIG. 4, have a spacing 608 from one another of between about one micrometer and about four micrometers. In other embodiments, coating 600 may have any suitable thickness and any suitable distribution of lamellae 604 that facilitates enabling coating 600 to function as described herein. Notably, the percentages by mass of second powder 506 set forth above for embodiments of powder mixture 512 are substantially the same percentages by mass exhibited in coating 600. Additionally, the above-described percentages by mass of second powder 506 in powder mixture 512 facilitate reduced clogging of spray gun 206 that would otherwise occur with greater percentages by mass of second powder 506.

The systems and methods described herein facilitate improvements in coatings used that enhance the surface properties of materials. For example, the systems and methods facilitate improvements in coatings that inhibit wear/erosion, corrosion, and/or thermal/electrical conductivity experienced by substrates on which the coatings are deposited. More specifically, the systems and methods facilitate mixing a soft (e.g., ductile) powder with a hard powder to deposit a coating having localized softer areas dispersed in its microstructure.

Some embodiments of the systems and methods facilitate improving the useful life of gas turbine assembly components (e.g., turbine rotor blades). In that regard, the systems and methods facilitate enabling the gas turbine assembly components to better withstand cyclic loading and associated wear. More specifically, the systems and methods facilitate improving the strain tolerance (e.g., the ductility) of a coating applied to gas turbine assembly components without making the coating soft enough to detract from its protective function. Thus, when the coating experiences cyclic stress, it can better expand/contract in accordance with the associated thermal and/or mechanical expansion/contraction of the underlying component, thereby improving the strain tolerance (e.g., fatigue-withstanding capability) of the coating while maintaining the wear resistance of the coated component. As such, the systems and methods facilitate providing a coating that is less prone to fracture during the expansion/contraction of the underlying component, particularly in higher-temperature environments. The systems and methods therefore facilitate eliminating the need for a separate post-processing operation on a coated component and/or a separate pre-processing operation on a component to be coated (e.g., shot peening, burnishing, annealing etc.). As a result, the systems and methods described herein facilitate reducing the cost of manufacturing a gas turbine assembly component and also facilitate increases to engine firing temperatures of a gas turbine assembly such that the overall operating efficiency of the gas turbine assembly is improved and the useful life of its components is extended.

Exemplary embodiments of coating systems and methods are described above in detail. The systems and methods described herein are not limited to the specific embodiments described herein, but rather, steps of the methods and components of the systems may be utilized independently and separately from other steps and components described herein. For example, the systems and methods described herein may have other applications not limited to practice with gas turbine assemblies, as described herein. Rather, the systems and methods described herein can be implemented and utilized in connection with various other industries.

While the invention has been described in terms of various specific embodiments, those skilled in the art will recognize that the invention can be practiced with modification within the spirit and scope of the claims.

What is claimed is:

1. A feedstock for use in coating a component, said feedstock comprising a powder mixture comprising a first powder comprising a plurality of first particles and a second powder comprising a plurality of second particles, said second powder being softer than said first powder, at least some of the plurality of first particles and at least some of the plurality of the second particles mechanically couple together to create a plurality of deformed particles, wherein the combination of the plurality of deformed particles and the plurality of second particles create localized areas of softer material within the feedstock.

2. A feedstock in accordance with claim 1, wherein said second powder has a Mohs hardness of at most three.

3. A feedstock in accordance with claim 2, wherein said second powder is a powdered metallic material that is one of aluminum, zinc, copper, bismuth, and tin.

4. A feedstock in accordance with claim 1, wherein said second powder has a percentage by mass of said powder mixture of between about 0.3% and about 0.7%.

5. A feedstock in accordance with claim 4, wherein said second powder has a percentage by mass of said powder mixture of about 0.5%.

6. A feedstock in accordance with claim 1, wherein each first particle of said plurality of first particles has a diameter of between about five micrometers and about sixteen micrometers.

7. A feedstock in accordance with claim 1, wherein each second particle of said plurality of second particles has a diameter of between about fifteen micrometers and about forty-five micrometers.

8. A feedstock in accordance with claim 1, wherein said powder mixture is capable of forming a coating that includes:

a plurality of first lamella, each first lamella comprising a first particle of said plurality of first particles; and a plurality of second lamella, each second lamella comprising a second particle of said plurality of second particles.

9. A feedstock in accordance with claim 1, wherein said first powder comprises at least one of the following metallic materials: a Stellite™ alloy; a Tribaloy™ alloy; an INCONEL® alloy; a tungsten carbide cobalt-chromium alloy; a chromium carbide nickel-chromium alloy; an aluminum oxide; a chromium oxide; a titanium oxide; a zirconium oxide; and a yttrium oxide.

10. A feedstock in accordance with claim 1, wherein said first powder comprises a ceramic material.

11. A feedstock in accordance with claim 10, wherein said second powder comprises at least one of aluminum, zinc, copper, bismuth, and tin.

12. A method for coating a component, said method comprising:

supplying a carrier fluid to a thermal spray gun;

supplying the feedstock according to claim 1 to the thermal spray gun; and discharging the powder mixture from the thermal spray gun via the carrier fluid to deposit a coating on the component.

13. A method in accordance with claim 12, further comprising discharging the powder mixture with the second powder having a Mohs hardness of at most three.

14. A method in accordance with claim 13, further comprising discharging the powder mixture with the second powder being a powdered metallic material that is one of substantially pure aluminum, substantially pure zinc, substantially pure copper, substantially pure bismuth, and substantially pure tin.

15. A method in accordance with claim 12, further comprising pre-mixing the first powder and the second powder in a mixer to make the powder mixture.

* * * * *